US009657905B2

(12) United States Patent
Coleiny et al.

(10) Patent No.: US 9,657,905 B2
(45) Date of Patent: May 23, 2017

(54) SAFETY SWITCH FOR RETROFIT TUBE

(71) Applicant: LEDVANCE LLC, Wilmington, MA (US)

(72) Inventors: Golshan Coleiny, Boston, MA (US); Shiyong Zhang, Boxborough, MA (US)

(73) Assignee: LEDVANCE LLC, Wilmington ( * ) Notice: Subject to any disclaimer, the term of this patent is extended or adjusted under 35 U.S.C. 154(b) by 19 days.

(21) Appl. No.: 14/872,131

(22) Filed: Sep. 30, 2015

(65) Prior Publication Data

US 2016/0230975 A1 Aug. 11, 2016

Related U.S. Application Data

(60) Provisional application No. 62/057,554, filed on Sep. 30, 2014.

(51) Int. Cl.

| | |
|---|---|
| ***F21K 9/27*** | (2016.01) |
| ***F21V 25/04*** | (2006.01) |
| *F21Y 115/10* | (2016.01) |

(52) U.S. Cl.

CPC ..... *F21K 9/27* (2016.08); *F21V 25/04* (2013.01); *F21Y 2115/10* (2016.08)

(58) Field of Classification Search

CPC ..... F21V 25/04; F21K 9/27; F21Y 2115/10; H01R 2103/00; H01R 13/7032

USPC ..... 362/221, 646, 649, 651, 657, 659, 802; 439/188; 200/310–314, 547–550, 252, 200/254, 531, 536

See application file for complete search history.

(56) References Cited

U.S. PATENT DOCUMENTS

| | | | | |
|---|---|---|---|---|
| 8,531,109 | B2 | 9/2013 | Visser et al. | |
| 8,622,571 | B2 | 1/2014 | Hartikka et al. | |
| D700,578 | S | 3/2014 | Cheng | |
| 8,847,475 | B2 * | 9/2014 | Heil | F21V 25/04 174/140 R |
| 8,894,430 | B2 * | 11/2014 | Simon | F21V 25/04 439/226 |
| 9,016,889 | B2 * | 4/2015 | Cheng-Wei | H01R 33/089 362/217.01 |
| 9,194,542 | B2 * | 11/2015 | Lin | F21K 9/175 |
| 2014/0029247 | A1 | 1/2014 | Gielen et al. | |
| 2014/0355261 | A1 * | 12/2014 | Dingemans | F21V 25/04 362/217.17 |

FOREIGN PATENT DOCUMENTS

CN 203249202 U 10/2013

* cited by examiner

*Primary Examiner* — Laura Tso

(74) *Attorney, Agent, or Firm* — Andrew Martin

(57) ABSTRACT

A safety switch for a lighting device is disclosed. The lighting device includes a plurality of solid state light sources and a housing encompassing these. The housing has a first end with a first end cap and an opening therein. A first set of pins extend from the first end cap, and are coupled to a first set of pin connectors. A movable actuator has a pair of electrical connectors that correspond to the first set of pin connectors and are coupled to the solid state light sources. A bridge that holds the pair of electrical connectors, and a holder extends from the bridge through the opening in the first end cap. The movable actuator is capable of movement between a closed position, which creates an electrical connection between the electrical connectors and the pin connectors, and an open position, wherein creates no such electrical connection.

8 Claims, 10 Drawing Sheets

SAFETY SWITCH FOR RETROFIT TUBE

CROSS-REFERENCE TO RELATED APPLICATION

The present application claims priority to and the benefit of U.S. Provisional Patent Application No. 62/057,554, entitled "SAFETY SWITCH" and filed Sep. 30, 2014, the entire contents of which are hereby incorporated by reference.

TECHNICAL FIELD

The present invention relates to lighting, and more specifically, to solid state light source-based retrofit tube lamps.

BACKGROUND

As solid state light sources become more commonly used in lighting devices, customers desire products that look similar to, and provide similar light outputs as, conventional lighting devices. Solid state light source-based lamps that are designed to replace incandescent and halogen lamps typically have a socket, just as the conventional lamps do. Solid state light source-based lamps that are designed to replace fluorescent lamps typically have two pins on each end, just as the conventional lamps do. Such tubular retrofit lamps differ electrically from the fluorescent lamps they are designed to replace. In a typical fluorescent lamp, the pins on one side of the lamp are not electrically connected within the lamp to the pins on the other side of the lamp. In a typical tubular retrofit lamp, the pins on one side of the lamps are electrically connected within the lamp to the pins on the other side of the lamp.

SUMMARY

Conventional tubular retrofit lamps thus suffer from a potential safety hazard, in that when one set of pins is placed into a tombstone socket, if that socket is receiving power, the pins on the other side of the lamp are hot (i.e., receiving electrical power). This may result in sparks, shocks, arcing, and the like, if the hot pins come into contact with metal or a person (such as an installer of the lamp). Some lamps include a safety mechanism designed to prevent such issues, but these safety mechanisms suffer from a variety of deficiencies. For example, some such safety mechanisms utilize a push-button that is to be pushed in only when the lamp is installed in the sockets. However, such a button may inadvertently be pushed during the installation process.

Embodiments overcome such deficiencies by providing a safety mechanism that utilizes a movable actuator to electrically connect at least one set of pins on at least one side of the lamp to the pins on the other side of the lamp after the lamp is installed in the sockets designed to provide electrical power to the lamp. The movable actuator has one or more electrical connectors that is/are in electrical contact with the substrate including the solid state light sources within the lamp. Until the movable actuator is placed into a closed position, there is no electrical connection between the electrical connector(s) of the movable actuator and the pins that are inserted into the socket. In some embodiments, the pins themselves are always attached to the movable actuator, and thus remain retracted within the lamp until the actuator is moved to the closed position. This prevents electrical shock and provides for safe installation of the lamp and safe removal of the lamp when it is replaced.

In an embodiment, there is provided a lighting device. The lighting device includes: a plurality of solid state light sources; a housing encompassing the plurality of solid state light sources, wherein the housing comprises a first end comprising a first end cap and an opening; a first set of pins extending from the first end cap; a first set of pin connectors, coupled to the first set of pins; and a movable actuator, wherein the movable actuator comprises a pair of electrical connectors that correspond to the first set of pin connectors and are coupled to the plurality of solid state light sources, a bridge that holds the pair of electrical connectors, and a holder extending from the bridge through the opening in the first end cap, wherein the movable actuator is capable of movement between a closed position and an open position, wherein the closed position results in an electrical connection between the pair of electrical connectors and the first set of pin connectors, and wherein the open position results in no electrical connection between the pair of electrical connectors and the first set of pin connectors.

In a related embodiment, movement of the holder may cause corresponding movement of the movable actuator between the open position and the closed position. In another related embodiment, the first set of pins and the first set of pin connectors may be coupled to the pair of electrical connectors of the movable actuator, such that the closed position results in the first set of pins extending from the first end cap and the open position results in the first set of pins being retracted within the first end cap.

In still another related embodiment, the plurality of solid state light sources may be coupled to a substrate having a planar shape, the substrate may include a pair of contacts, and the pair of electrical connectors are in electrical connection with the pair of contacts. In yet another related embodiment, the housing may further include a second end including a second end cap, and the lighting device may further include a second set of pairs extending from the second end cap and in electrical connection with the plurality of solid state light sources. In a further related embodiment, the second end and the second end cap may be opposite the first end and the first end cap.

In yet still another related embodiment, the first end cap may further include a second opening, and the movable actuator may further include a second holder extending from the bridge through the second opening in the first end cap, such that both the holder and the second holder may be configured to move the movable actuator between the closed position and the open position. In a further related embodiment, the opening and the second opening may each include a slot.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1A:
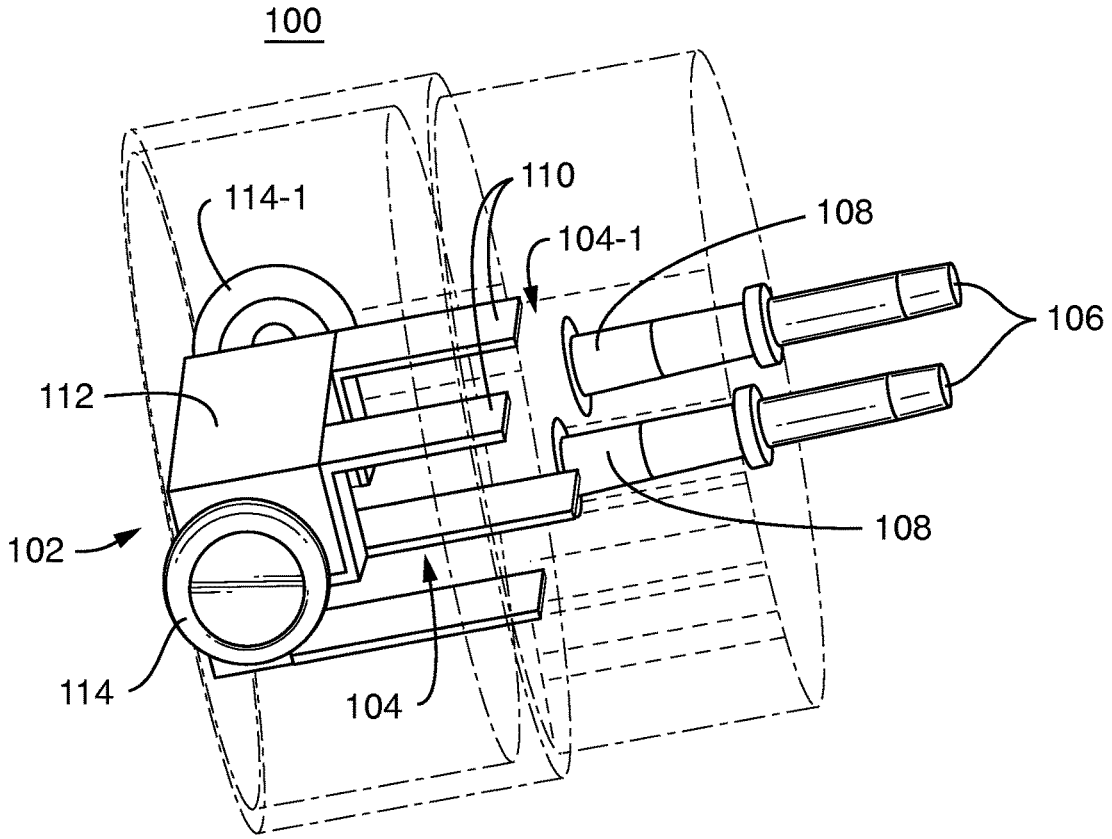
FIG. 1A shows a transparent view of end cap of a retrofit tube including a movable actuator according to embodiments disclosed herein.

FIG. 1A shows an internal view of an end cap 100 with a movable actuator 102 according to embodiments disclosed herein. The end cap 100 includes an opening 104 and a set of pins 106 extending from the end cap 100. A set of pin connectors 108 are coupled to the set of pins 106. The movable actuator 102 includes a pair of electrical connectors 110 that correspond to the set of pin connectors 108 and are coupled to a plurality of solid state light sources 150 (not shown in FIG. 1A but shown in FIG. 1D). A bridge 112 holds the pair of electrical connectors 110. A holder 114 extends from the bridge 112 through the opening 104. In some embodiments, as shown more clearly in FIG. 1C, the end cap 100 includes a second opening 104-1, and the movable actuator 102 includes a second holder 114-1 that extends through the second opening 104-1. In some embodiments, the opening 104 is a slot 199, though of course the opening 104 may be, and in some embodiments is, any shape that accommodates the holder 114 extending therethrough and allowing movement of the holder 114 (and thus the movable actuator 102) as explained in greater detail herein. In some embodiments including the second opening 104-1, the second opening 104-1 is also a slot, and in some embodiments, the second opening 104-1 is any shape that accommodates the second holder 114-1 extending therethrough and allowing movement of the second holder 114-1 (and thus the movable actuator 102) as explained in greater detail herein.

Figure 1B:
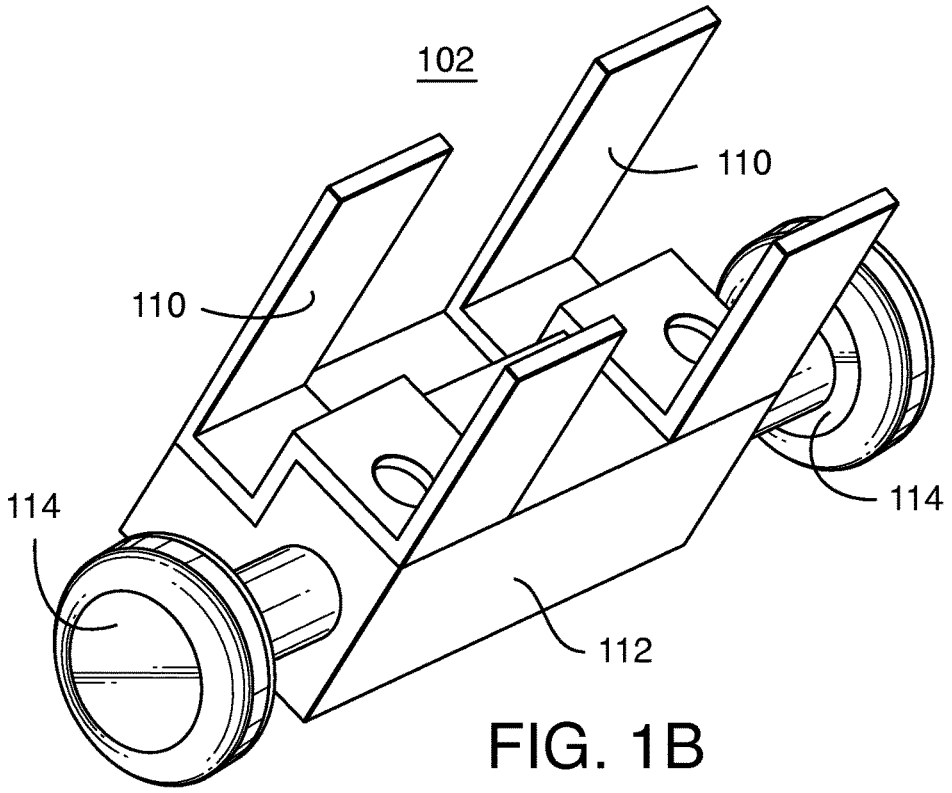
FIG. 1B shows the movable actuator of FIG. 1A according to embodiments disclosed herein.
Figure 1C:
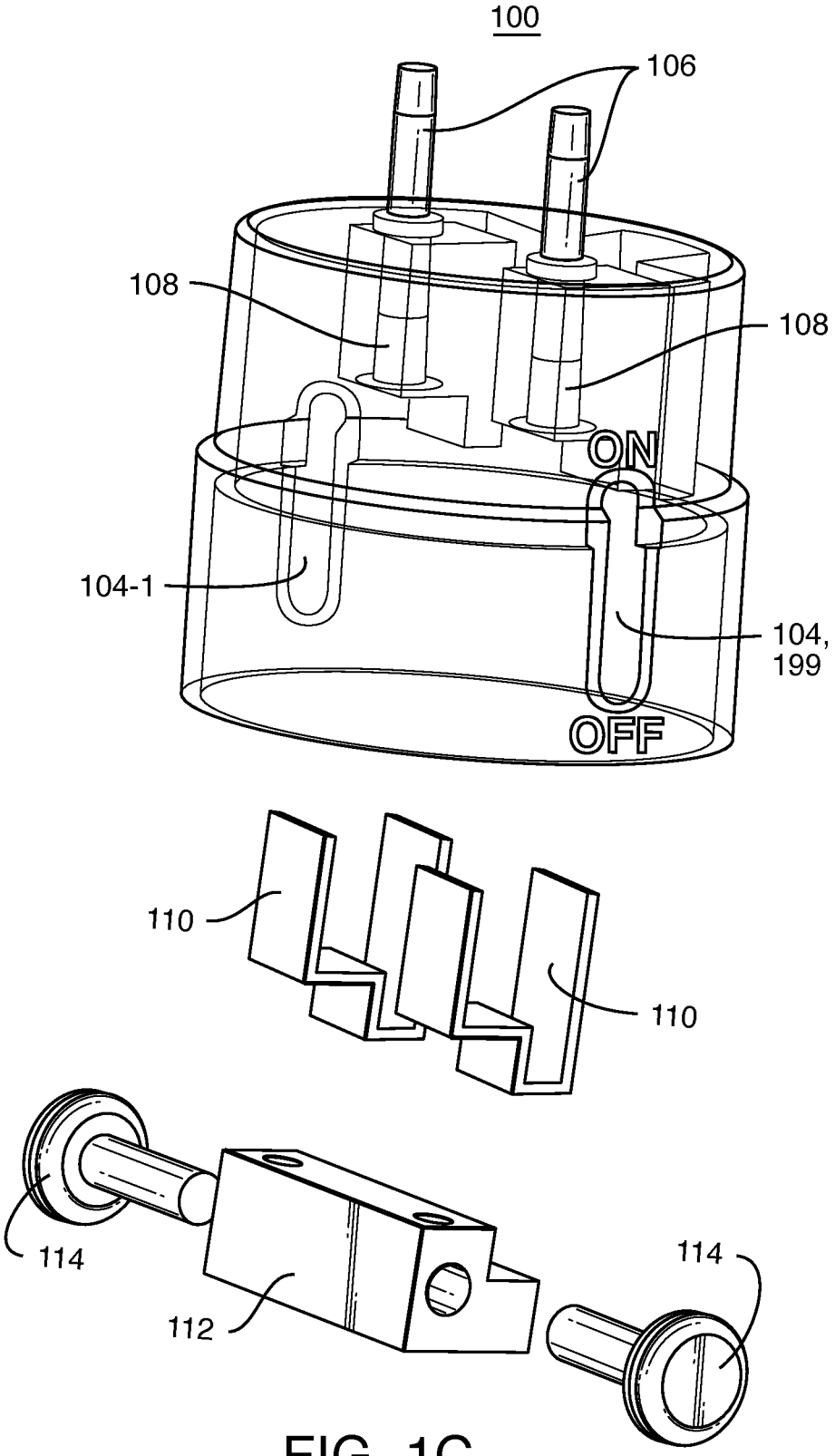
FIG. 1C shows an exploded view of the movable actuator of FIGS. 1A-1B according to embodiments disclosed herein.
Figure 1D:
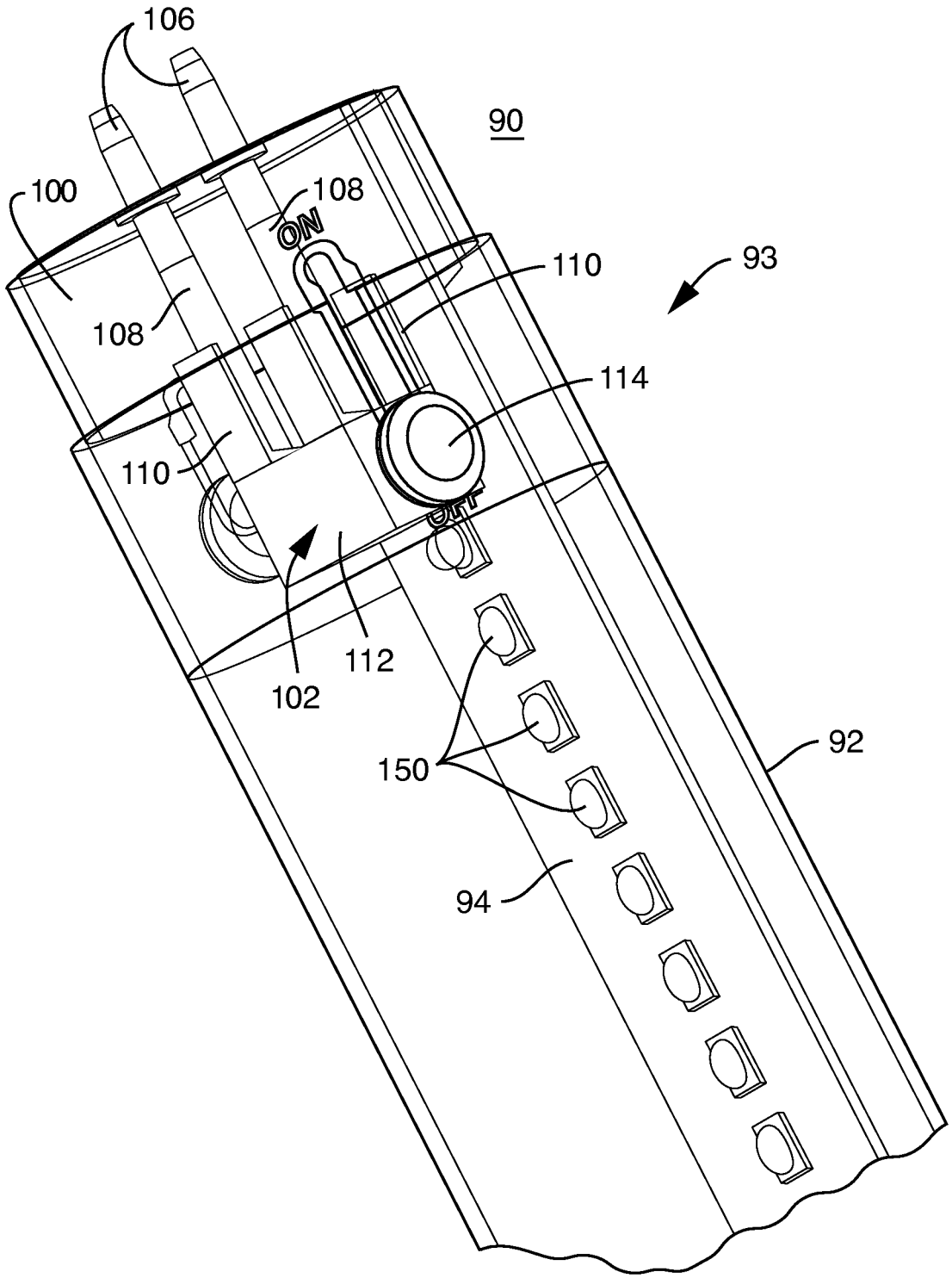
FIG. 1D shows a portion of a retrofit tube include a movable actuator in the end cap in an open position according to embodiments disclosed herein.

The movable actuator 102 is capable of movement between a closed position (shown in FIG. 1E) and an open position (shown in FIGS. 1A and 1D). The closed position results in an electrical connection between the pair of electrical connectors 110 and the set of pin connectors 108, and thus the set of pins 106. The open position results in no electrical connection between the pair of electrical connectors 110 and the set of pin connectors 108, and thus the set of pins 106 are not electrically connected to the pair of electrical connectors 110. The movement of the holder 114 (and in embodiments including more than one holder 114, a holder or more than one holder) causes corresponding movement of the movable actuator 102 between the open position and the closed position. When the movable actuator 102 moves between the closed position and the open position, the set of pins connectors 108 and thus the set of pins 106 are brought into and out of electrical contact with the pair of electrical connectors 110. The pair of electrical connectors 110 are always in electrical contact with the plurality of solid state light sources 150 (see FIG. 3), which are in electrical contact with a set of pins (not shown in FIG. 1A but shown in FIG. 4) on an end opposite from the end cap 100. Thus, when installing a lighting device including the end cap 100 with the movable actuator 102, placing the movable actuator 102 in the open position results in no electricity appearing at the set of pins 106, even when the pins on the end opposite from the end cap 100 are receiving electricity. Only when the movable actuator 102 is moved to the closed position does electricity appear at the set of pins 106 from the pins on the end opposite from the end cap 100. Thus, such a lighting device may be safely installed with reduced risk of electrical shock to the installer, as the installer should not move the movable actuator 102 into the closed position until the lighting device is properly installed.

Figure 1E:
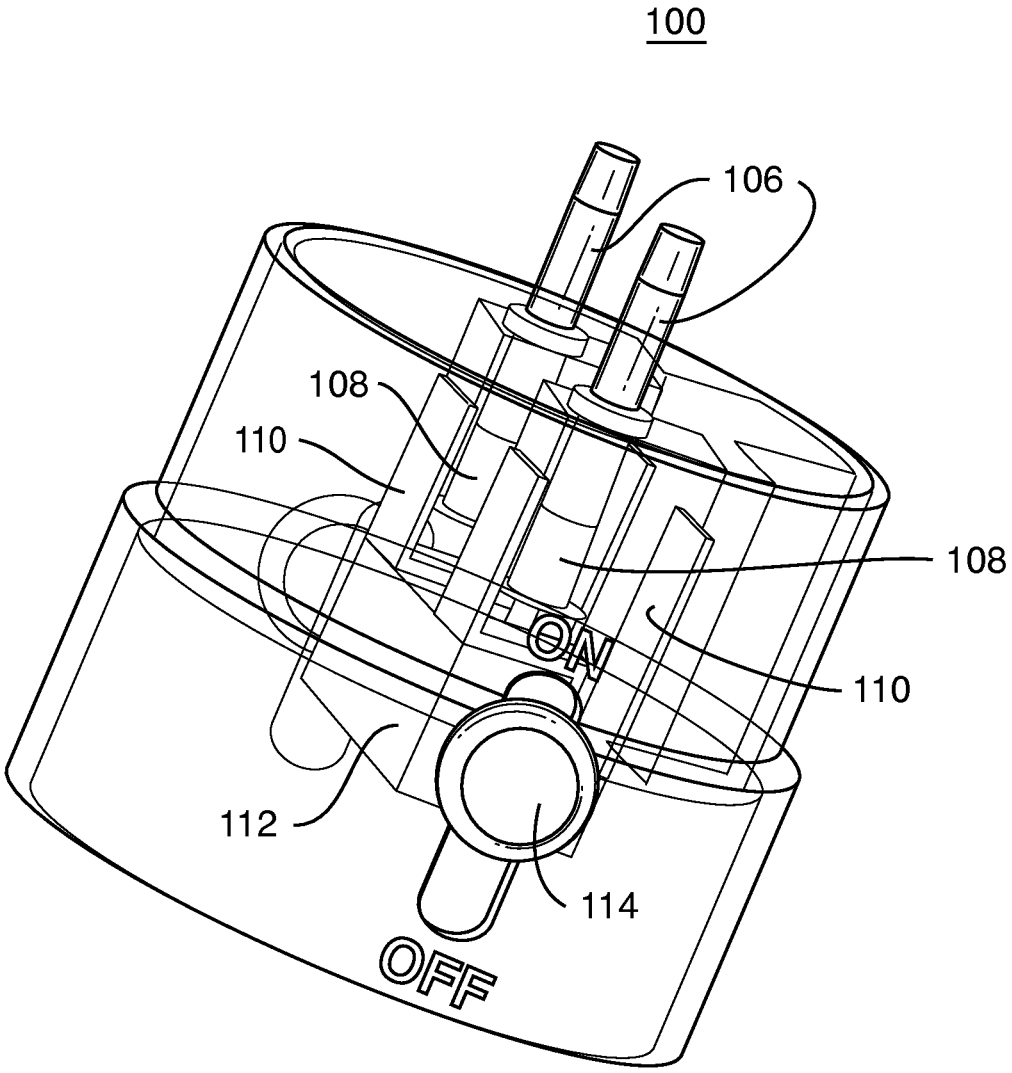
FIG. 1E shows a portion of an end cap of a retrofit tube include a movable actuator in the end cap in a closed position according to embodiments disclosed herein.

FIG. 1B shows the movable actuator 102 in more detail, with the set of pins 106 and the set of pin connectors 108 separate from the pair of electrical connectors 110. FIG. 1C shows the end cap 100 and the movable actuator 102 in an exploded view, with slots 104, 104-1 on each side of the end cap 100, through which the holders 114 extend. FIG. 1D shows a portion of a lighting device 90 including a housing 92 having an end 93, the plurality of solid state light sources 150 on a substrate 94, and the end cap 100 at the end 93 with the movable actuator 102 in the open position. FIG. 1E shows the end cap 100 with the movable actuator 102 in the closed position, thus electrically connecting the set of pins 106 to the substrate 94 and the plurality of solid state light sources 150 located thereon (not shown). This coupling is done in any known way, so long as the coupling is an electrical coupling, such that electricity is able to pass from the set of pins 106 to the electrical connectors 110 and vice versa.

Figure 2A:
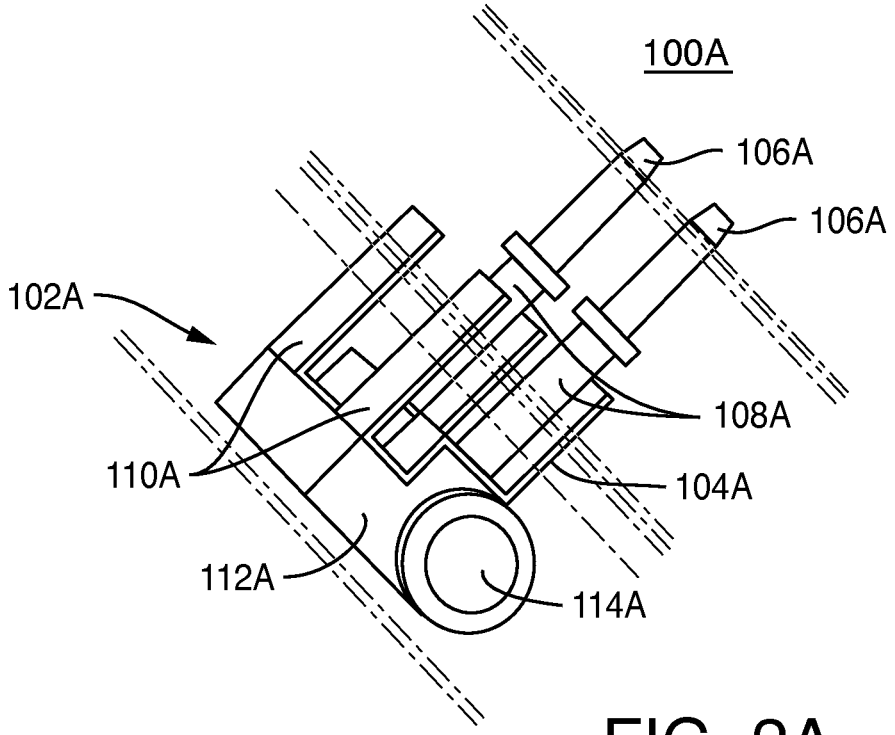
FIG. 2A shows a transparent view of end cap of a retrofit tube including a movable actuator according to embodiments disclosed herein.

FIG. 2A shows an internal view of an end cap 100A with a movable actuator 102A according to embodiments disclosed herein. The end cap 100A of FIG. 2A is similar to the end cap 100 of FIG. 1A. Thus, the end cap 100A includes an opening 104A and a set of pins 106A extending from the end cap 100A. A set of pin connectors 108A are coupled to the set of pins 106A. The movable actuator 102A includes a pair of electrical connectors 110A that correspond to the set of pin connectors 108A and are coupled to a plurality of solid state light sources 150A (not shown in FIG. 2A but shown in FIGS. 2D-2E). A bridge 112A holds the pair of electrical connectors 110A. A holder 114A extends from the bridge 112A through the opening 104A. In FIG. 2A, unlike in FIG. 1A, the set of pins 106A and the set of pin connectors 108A are coupled to the pair of electrical connectors 110A of the movable actuator 102A. The movable actuator 102A is capable of movement between a closed position (shown in FIG. 2E) and an open position (shown in FIGS. 2A and 2D). Due to the coupling of the set of pins 106A and the set of pin connectors 108A with the pair of electrical connectors 110A, when the movable actuator 102A moves between the closed position and the open position, the set of pins 106A and the set of pin connectors 108A move along with the movable actuator 102A. Thus, the closed position results in the set of pins 106A extending from the end cap 100A (as shown in FIG. 2E) and the open position results in the set of pins 106A being retracted within the end cap 100A (as shown in FIGS. 2A and 2D).

Figure 2B:
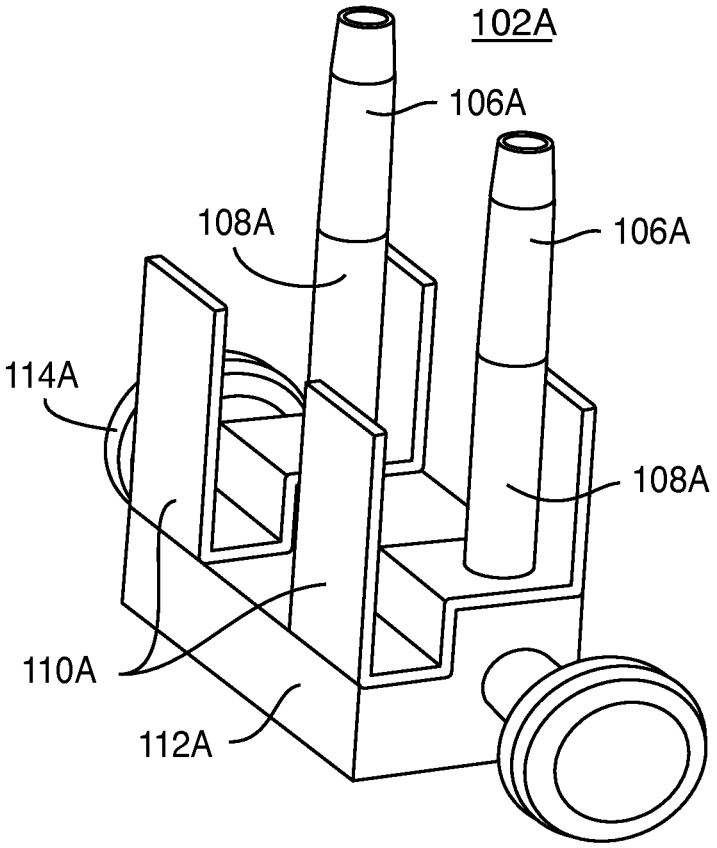
FIG. 2B shows the movable actuator of FIG. 2A according to embodiments disclosed herein.
Figure 2C:
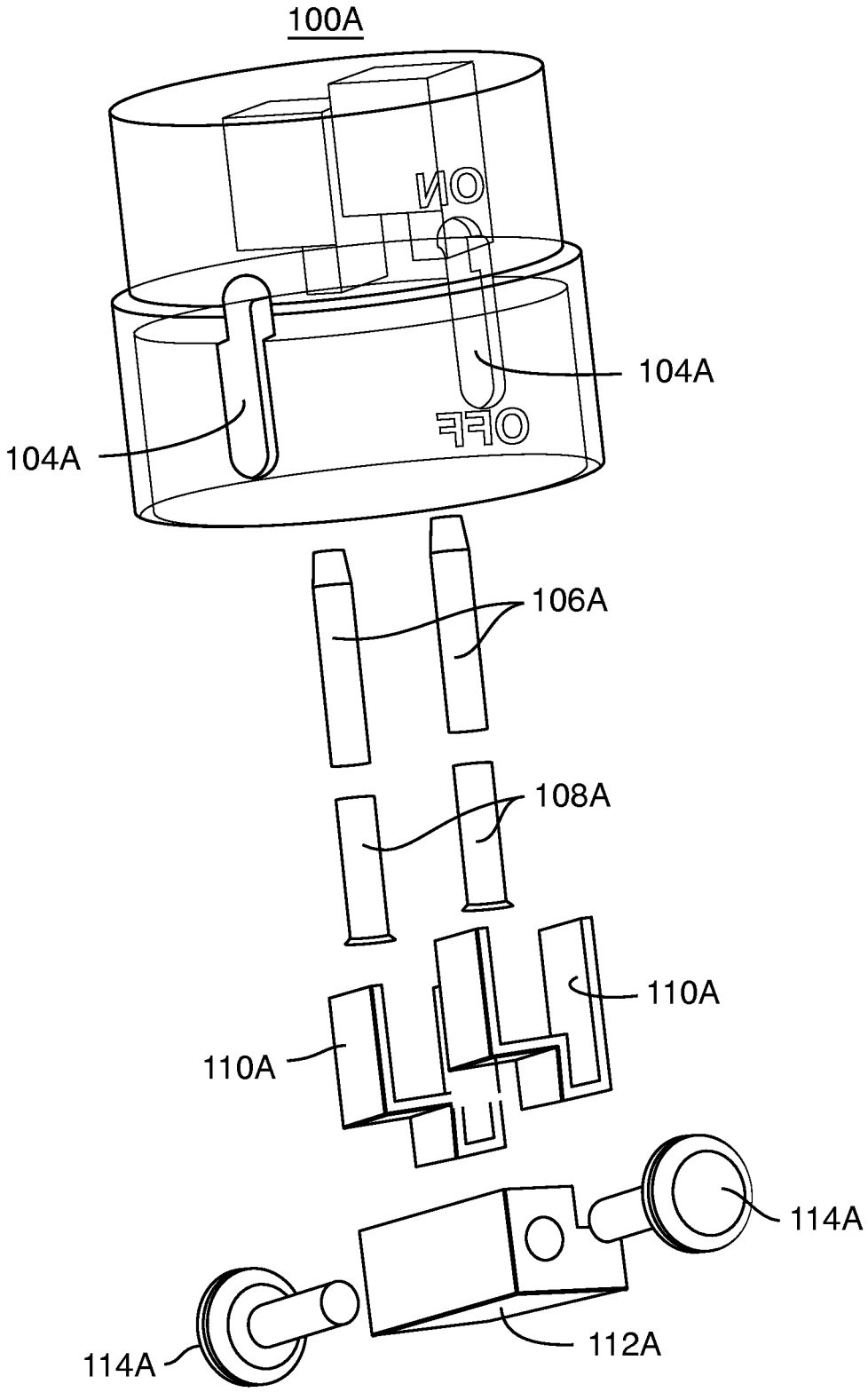
FIG. 2C shows an exploded view of the movable actuator of FIGS. 2A-2B according to embodiments disclosed herein.
Figure 2D:
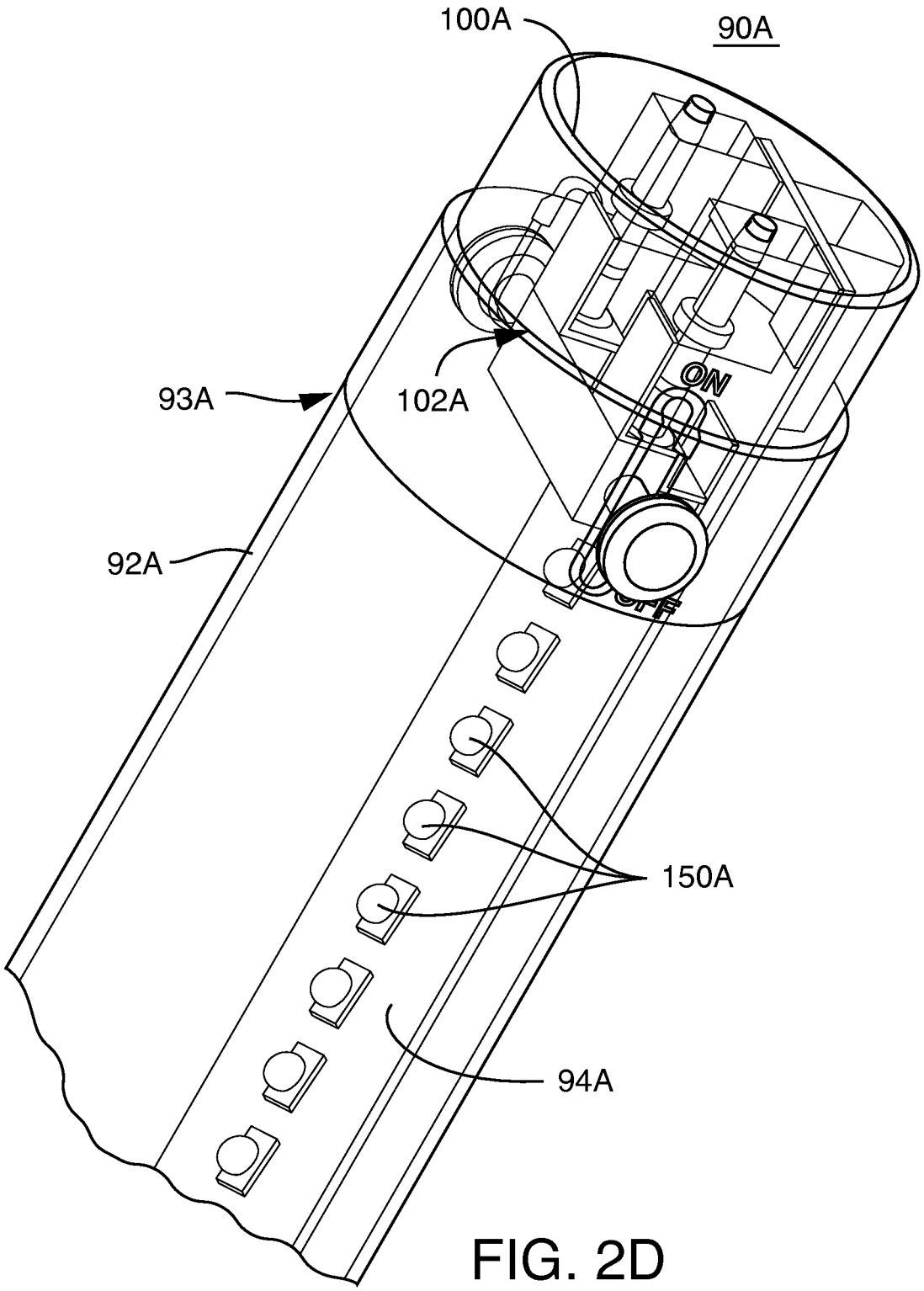
FIG. 2D shows a portion of a retrofit tube include a movable actuator in the end cap in an open position according to embodiments disclosed herein.
Figure 2E:
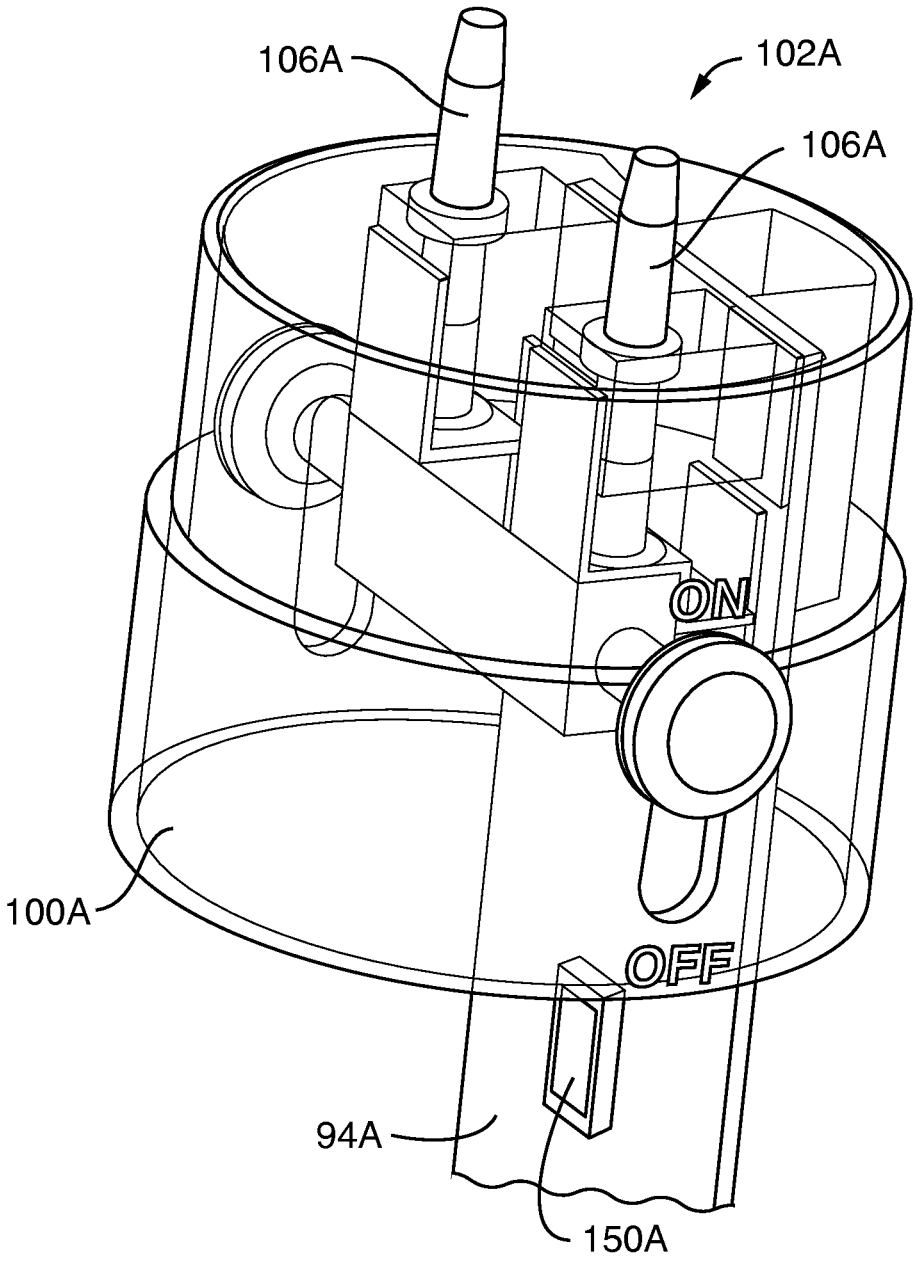
FIG. 2E shows a portion of an end cap of a retrofit tube include a movable actuator in the end cap in a closed position according to embodiments disclosed herein.

FIG. 2B shows the movable actuator 102A in more detail, with the set of pins 106A and the set of pin connectors 108A coupled to the pair of electrical connectors 110A. This coupling is done in any known way, so long as the coupling is an electrical coupling, such that electricity is able to pass from the set of pins 106A to the electrical connectors 110A and vice versa. FIG. 2C shows the end cap 100A and the movable actuator 102A in an exploded view, with slots 104A on each side of the end cap 100A, through which the holders 114A extend. FIG. 2D shows a portion of a lighting device 90A including a housing 92A, the plurality of solid state light sources 150A on a substrate 94A, and the end cap 100A with the movable actuator 102A in the open position. FIG. 2E shows the end cap 100A with the movable actuator 102A in the closed position, thus electrically connected to the substrate 94A and the plurality of solid state light sources 150A located thereon.

Figure 3:
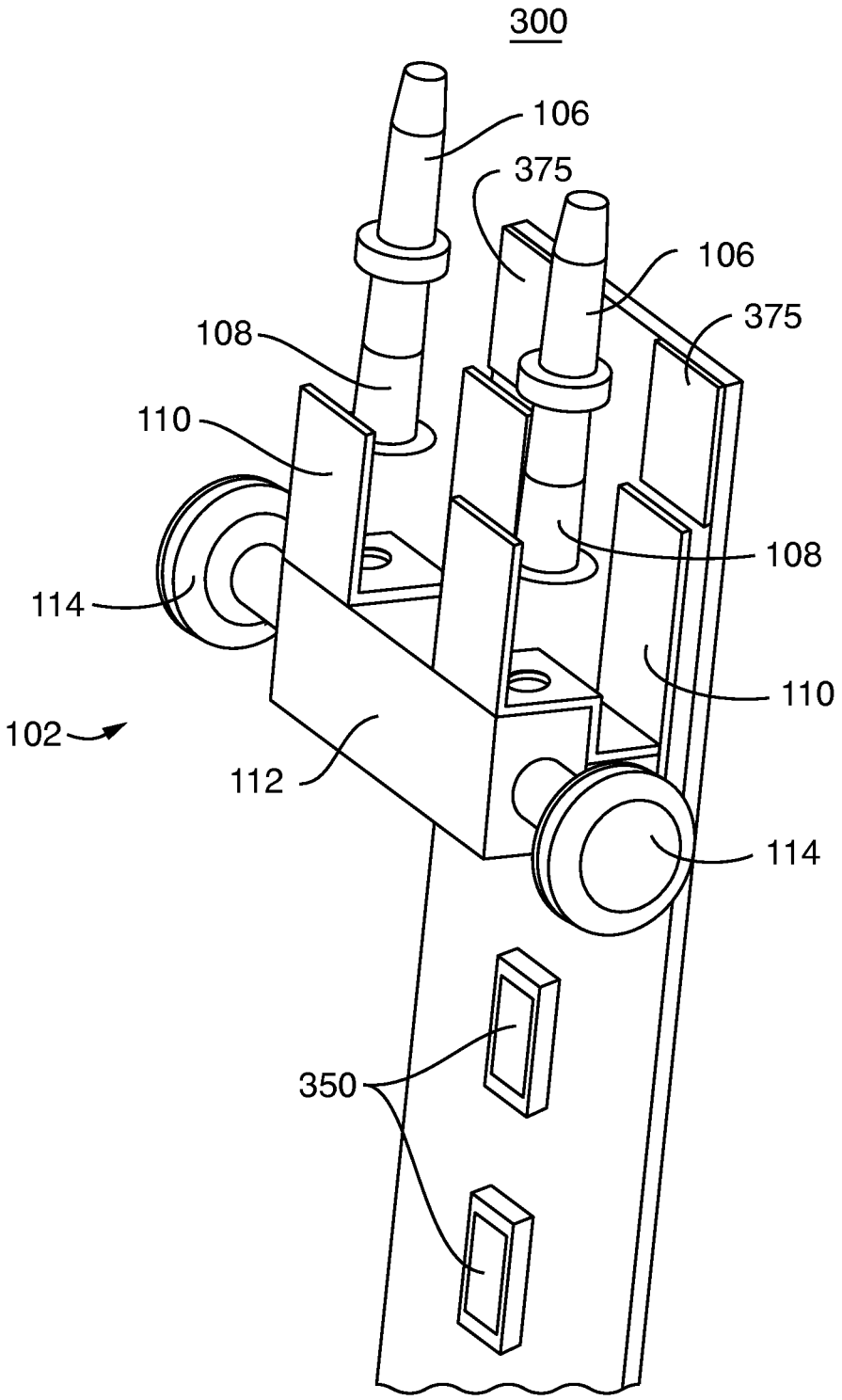
FIG. 3 shows a portion of a substrate including solid state light sources with contacts and a movable actuator according to embodiments disclosed herein.

FIG. 3 shows a substrate 300 having a planar shape, the movable actuator 102 of FIGS. 1A-1E, and the set of pins 106 and the pin connectors 108. The movable actuator 102 is in the open position, such that there is no electrical connection between the set of pins 106 and the pair of electrical connectors 110. The substrate 300 has a plurality of solid state light sources 350 coupled thereto. The substrate 300 also has a pair of contacts 375 located thereon. The pair of contacts 375 are in electrical contact with the plurality of solid state light sources 350. The pair of contacts 375 are also in electrical connection with the pair of electrical connectors 110. This electrical connection exists whether the movable actuator 102 is in the open position, as shown, or in the closed position (such as shown in FIG. 1E), as the pair of contacts 375 remain in electrical contact with the pair of electrical connectors 110 regardless of the position of the pair of electrical connectors 110 (and thus the movable actuator 102).

Figure 4:
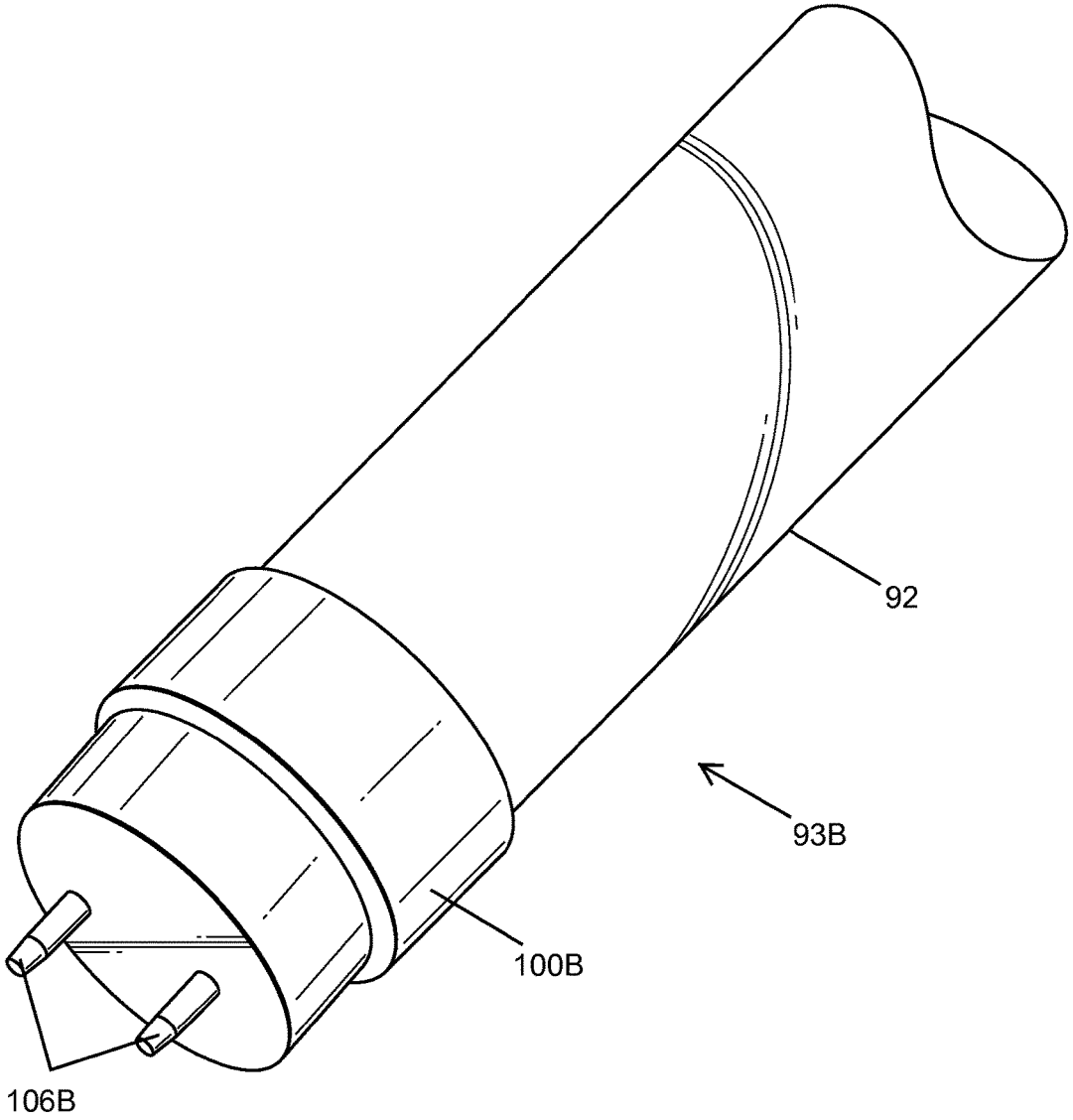
FIG. 4 shows an opposite end of a lighting device with an end cap that does not include a movable actuator, according to embodiments disclosed herein.

In some embodiments, such as with the portion of the lighting device 90 shown in FIG. 4, the housing 92 includes a second end 93B with a second end cap 100B, with a second set of pins 106B that extend out from the second end cap 100B. The second set of pins 106B are in electrical connection with the plurality of solid state light sources 150 within the housing 92 (not shown in FIG. 4). The second end 93B, and thus second end cap 100B, are opposite the end 93 and the end cap 100 shown in FIG. 1D. Of course, in some embodiments, the second end 93B and the second end cap 100B are opposite the end cap 100A and its corresponding end 93A shown in FIG. 2D. Though embodiments show lighting devices including end caps with two pins, this is for ease of description only, and embodiments are not so limited. Thus, in some embodiments, only a single pin extends out from an end cap, and is brought into electrical connection, or removed from electrical connection, with a plurality of solid state light sources by a movable actuator. Similarly, in some embodiments, only a single pin is coupled to a movable actuator, and extends out from, or retracts within, an end cap of the lighting device. Further, in some embodiments, the opposite end of the lighting device has only a single pin. In some embodiments, three pins, four pins, five pins, and so on, including combinations thereof, are used. In some embodiments, the opposite end of the lighting device includes an end cap with a movable actuator as well, such that both ends of the lighting device each include an end cap with a movable actuator. Though the housing shown in embodiments is tubular, this is for ease of description and similarity with well-known conventional tubular fluorescent lamps having one or more pins, such as T12, T8, and T5 lamps, and thus embodiments are not so limited. Thus, embodiments include lighting devices having any shape, so long as there are electrical connections on two sides of the lighting device. Further, some embodiments include lighting devices having shapes similar to other types of conventional fluorescent lamps, such as but not limited to U-bend lamps, seamless lamps, racetrack-shaped lamps, and so on.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A lighting device, comprising:

a plurality of solid state light sources;

a housing encompassing the plurality of solid state light sources, wherein the housing comprises a first end comprising a first end cap and an opening;

a first set of pins extending from the first end cap;

a first set of pin connectors, coupled to the first set of pins; and a movable actuator, wherein the movable actuator comprises a pair of electrical connectors that correspond to the first set of pin connectors and are coupled to the plurality of solid state light sources, a bridge that holds the pair of electrical connectors, and a holder extending from the bridge through the opening in the first end cap, wherein the movable actuator is capable of movement between a closed position and an open position, wherein the closed position results in an electrical connection between the pair of electrical connectors and the first set of pin connectors, and wherein the open position results in no electrical connection between the pair of electrical connectors and the first set of pin connectors.

2. The lighting device of claim 1, wherein movement of the holder causes corresponding movement of the movable actuator between the open position and the closed position.

3. The lighting device of claim 1, wherein the first set of pins and the first set of pin connectors are coupled to the pair of electrical connectors of the movable actuator, such that the closed position results in the first set of pins extending from the first end cap and the open position results in the first set of pins being retracted within the first end cap.

4. The lighting device of claim 1, wherein the plurality of solid state light sources are coupled to a substrate having a planar shape, wherein the substrate comprises a pair of contacts, and wherein the pair of electrical connectors are in electrical connection with the pair of contacts.

5. The lighting device of claim 1, wherein the housing further comprises a second end comprising a second end cap, and wherein the lighting device further comprises:

a second set of pairs extending from the second end cap and in electrical connection with the plurality of solid state light sources.

6. The lighting device of claim 5, wherein the second end and the second end cap are opposite the first end and the first end cap.

7. The lighting device of claim 1, wherein the first end cap further comprises a second opening, and wherein the movable actuator further comprises a second holder extending from the bridge through the second opening in the first end cap, such that both the holder and the second holder are configured to move the movable actuator between the closed position and the open position.

8. The lighting device of claim 7, wherein the opening and the second opening each comprise a slot.

* * * * *